US008292692B2

(12) United States Patent
Bajaj

(10) Patent No.: US 8,292,692 B2
(45) Date of Patent: Oct. 23, 2012

(54) POLISHING PAD WITH ENDPOINT WINDOW AND SYSTEMS AND METHOD USING THE SAME

(75) Inventor: Rajeev Bajaj, Fremont, CA (US)

(73) Assignee: Semiquest, Inc., San Jose, CA (US)

( * ) Notice: Subject to any disclaimer, the term of this patent is extended or adjusted under 35 U.S.C. 154(b) by 517 days.

(21) Appl. No.: 12/616,323

(22) Filed: Nov. 11, 2009

(65) Prior Publication Data

US 2010/0130112 A1 May 27, 2010

Related U.S. Application Data

(60) Provisional application No. 61/118,431, filed on Nov. 26, 2008.

(51) Int. Cl.
*B24B 49/00* (2012.01)

(52) U.S. Cl. ..... 451/5; 451/56; 451/443

(58) Field of Classification Search ..... 451/6, 41, 451/56, 443, 444, 527
See application file for complete search history.

(56) References Cited

U.S. PATENT DOCUMENTS

| | | | | |
|---|---|---|---|---|
| 5,607,346 | A | 3/1997 | Wilson et al. | |
| 5,609,517 | A | 3/1997 | Lofaro | |
| 5,795,218 | A | 8/1998 | Doan et al. | |
| 6,089,965 | A | 7/2000 | Otawa et al. | |
| 6,612,916 | B2 | 9/2003 | Kollodge et al. | |
| 6,962,524 | B2 | 11/2005 | Butterfield et al. | |
| 6,986,705 | B2 | 1/2006 | Preston et al. | |
| 7,160,181 | B2 * | 1/2007 | Jeung | 451/285 |
| 7,530,880 | B2 * | 5/2009 | Bajaj et al. | 451/5 |
| 7,815,778 | B2 * | 10/2010 | Bajaj | 204/224 M |
| 8,066,555 | B2 * | 11/2011 | Bajaj | 451/527 |
| 8,075,745 | B2 * | 12/2011 | Bajaj | 204/224 M |
| 2001/0035354 | A1 | 11/2001 | Ashjaee et al. | |
| 2003/0132120 | A1 | 7/2003 | Emesh et al. | |
| 2003/0153245 | A1 | 8/2003 | Talieh et al. | |
| 2004/0255521 | A1 * | 12/2004 | Jeung | 51/295 |
| 2007/0131564 | A1 * | 6/2007 | Bajaj | 205/675 |
| 2008/0164153 | A1 * | 7/2008 | Bajaj | 205/663 |
| 2008/0248734 | A1 * | 10/2008 | Bajaj | 451/527 |
| 2010/0203815 | A1 * | 8/2010 | Bajaj | 451/446 |
| 2011/0143539 | A1 * | 6/2011 | Bajaj et al. | 438/692 |

OTHER PUBLICATIONS

Bajaj, Rajeev; PCT/US05/35978 filed Oct. 5, 2005; International Preliminary Report on Patentability; WIPO; Jun. 7, 2007; 7pp.

(Continued)

*Primary Examiner* — Maurina Rachuba
(74) *Attorney, Agent, or Firm* — SNR Denton US LLP

(57) ABSTRACT

A polishing pad includes a guide plate, a compressible foam under layer disposed adjacent to a lower surface of the guide plate, and a plurality of polishing elements that extend in a first direction substantially normal to a plane defined by the guide plate and through the guide plate. The pad further includes an optical path along the first direction and which is defined by an aperture in the compressible foam under layer and the guide plate. The optical path includes a transparent window that extends above an upper surface of the guide plate but below tips of the polishing elements, the upper surface of the guide plate being opposite the lower surface thereof. An optional slurry distribution layer may be disposed on the upper surface of the guide plate, in which case the polishing elements extend through the slurry distribution layer and the transparent window extends beyond a top surface thereof.

10 Claims, 6 Drawing Sheets

OTHER PUBLICATIONS

Bajaj, Rajeev; PCT/US05/35979 filed Oct. 5, 2005; International Preliminary Report on Patentability; IPEA/US; Sep. 27, 2006; 7pp.

Bajaj, Rajeev; PCT/US05/35732 filed Oct. 5, 2005; International Preliminary Report on Patentability; WIPO; Jun. 7, 2007; 5pp.

Bajaj, Rajeev; PCT/US05/35660 filed Oct. 5, 2005; International Preliminary Report on Patentability; WIPO; Jul. 19, 2007; 6pp.

Bajaj, Rajeev; PCT/US05/35979 filed Oct. 5, 2005; International Search Report and Written Opinion; ISA/US; Feb. 24, 2006; 8pp.

Bajaj, Rajeev; PCT/US05/35732 filed Oct. 5, 2005; International Search Report and Written Opinion; ISA/US; Nov. 28, 2006; 6pp.

Bajaj, Rajeev; PCT/US05/35660 filed Oct. 5, 2005; International Search Report and Written Opinion; Jun. 15, 2007; 8pp.

Bajaj, Rajeev; PCT/US05/35978 filed Oct. 5, 2005; International Search Report and Written Opinion; ISA/US; Mar. 15, 2006; 9pp.

SEMIQUEST, Inc.; PCT/US2008/074658 filed Aug. 28, 2008; International Preliminary Report on Patentability; IPEA/US; mailed Aug. 3, 2010; 9 pp.

* cited by examiner

POLISHING PAD WITH ENDPOINT WINDOW AND SYSTEMS AND METHOD USING THE SAME

RELATED APPLICATION

This application is a NONPROVISIONAL and claims the priority benefit of U.S. Provisional Patent Application No. 61/118,431, filed Nov. 26, 2008, incorporated herein by reference.

FIELD OF THE INVENTION

The present invention relates to the field of chemical mechanical planarization (CMP) and relates specifically to a CMP polishing pad having an optically transparent window therein.

BACKGROUND

In modern integrated circuit (IC) fabrication, layers of material are applied to embedded structures previously formed on semiconductor wafers. Chemical Mechanical Planarization (CMP) is an abrasive process used to remove these layers (or portions thereof) and polish the resulting surface to achieve a desired structure. CMP may be performed on both oxides and metals and generally involves the use of chemical slurries applied in conjunction with a polishing pad in motion relative to the wafer (e.g., the pad rotates relative to the wafer with the slurry dispersed therebetween). The resulting smooth flat surface is necessary to maintain photolithographic depth of focus for subsequent wafer processing steps and to ensure that the metal interconnects are not deformed over contour steps. Damascene processing requires metal, such as tungsten or copper, to be removed from the top surface of a dielectric to define interconnect structures, using CMP.

FIG. 1 shows a cross-section of a polishing pad 100 made by SemiQuest, Inc. This polishing pad is described in U.S. patent application Ser. No. 11/576,944, filed 9 Apr. 2007, assigned to the assignee of the present invention and incorporated herein by reference. Pad 100 consists of polishing elements 102, which rest on a compressible under-foam 104 and are supported in vertical orientation by a guide plate 106. An optional slurry distribution layer 108 may be disposed above the guide plate. Polishing action is provided by the polishing elements, which are made of solid polymer material, while slurry distribution is effected by the open spaces between the polishing elements.

As discussed in U.S. patent application Ser. No. 11/576,944, the ability to monitor process conditions while a wafer is being polished is important as it can provide information on the wafer surface, which, in turn, may be utilized to change the process conditions or stop processing all together. As is known in the art, some CMP systems use optical means to monitor process conditions. In particular, a light beam is directed toward the wafer through an open aperture in the polishing pad and reflected off of the wafer surface being polished. Changes in the reflected beam can be analyzed to determine the condition of the polishing process. Examples of systems, pads and methods for such process monitoring are described in U.S. Pat. Nos. 7,264,536, 7,374,477, 7,118,450, 7,029,747, 6,884,156, 6,524,164, 6,280,290, 5,893,796, 5,609,517, and 5,433,651, each incorporated herein by reference.

BRIEF DESCRIPTION OF DRAWINGS

The present invention is illustrated by way of example, and not limitation, in the figures of the accompanying drawings, in which.

DETAILED DESCRIPTION

In a conventional CMP apparatus, a polishing pad is disposed on a platen and a wafer or other substrate is brought into rotational contact with the polishing elements of the pad, usually in the presence of a slurry. This effects polishing of the wafer. As indicated above, some CMP systems employ process monitoring means which reflect light beams off of the wafer surface being polished and analyze the reflected beams to determine polishing process characteristics. These systems may use visible or other wavelengths of light and may be single or multi-wavelength systems. The light is usually emitted from below the platen (e.g., by a laser), directed through an opening in the platen and the polishing pad onto the wafer surface, and then reflected through a similar path towards a detector. Thus, polishing pads used in such apparatus require an opening through which the light beam may pass.

Figure 2:
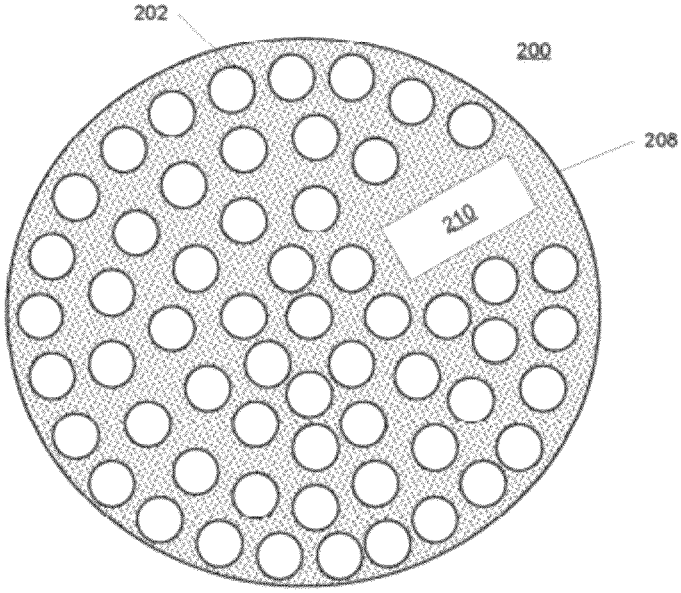
FIG. 2 is a top view of a polishing pad including a transparent portion configured in accordance with an embodiment of the present invention.

Referring now to FIG. 2, a top view of a polishing pad 200 is shown. Polishing pad 200 is similar to polishing pad 100 in that it has a variety of polishing elements 202, which rest on a compressible under-foam (not shown in this view) and are supported in vertical orientation by a guide plate (not shown in this view). A slurry distribution layer 208 is disposed above the guide plate and is shown in this view, however, the slurry distribution layer is optional. In some cases, the various polishing elements may be polymeric and may be made of an electrically conductive material such as a conductive polymer polyaniline commercially known as Pani™ (available under the trade name ORMECOM™), carbon, graphite or metal filled polymer. In other embodiments, the polishing elements may be made of a thermally conductive material, such as carbon, graphite or metal filled polymer. The slurry distribution material may be an open cell foam and the compressible under-layer a closed cell foam. As discussed further below, the slurry distribution function may also be accomplished by providing grooves on the guide plate or creating baffles such that slurry flow is modulated.

When the pad is in use (i.e., when it is moving relative to a wafer surface), the polishing elements may make sliding contact or rolling contact with the wafer's surface. In this latter case, one or more polishing elements may have a cylindrical body and a rolling tip. The rolling tip may be made of varying materials, such as polymeric, metal oxide or an electrically conducting material. A rolling tip polishing element may be incorporated into the pad material the same way as a sliding contact polishing element. Of course, the individual polishing elements (or tips thereof) can have a variety of shapes (e.g., circular, triangular, and/or trapezoidal cross-sectional shapes) and this is not critical to the present invention. By providing for independent movement of the polishing elements along an axis normal to a plane defined by the guide plate, the present polishing pad is able to apply uniform (or near uniform) pressure across the entire surface of the wafer. This unique ability eliminates "hot spots" on the wafer which might cause local material removal rate variations or, in case of low-K materials, initiate material or interface failure damage.

In varying embodiments of the present invention, the polishing elements of the pad may be made of any suitable material such as polymer, metal, ceramic or combinations thereof, and are capable of independent or semi-independent movement in the axis normal to the plane defined by the guide plate. The polishing elements may be of different sizes and may be positioned with varying density across the pad surface. Also in varying embodiments of the invention, a pad may be made from elements that preferentially polish copper and is used to remove copper utilizing copper slurry. Another pad may be made from elements that preferentially polish barrier materials, such as Ta/TaN or other such refractory metals, and is used to remove barrier materials utilizing barrier slurry.

A suitable material for the polishing elements of the present polishing pad is cast or molded polyurethane, such as DOW Pellethane™ 2201 65D. Other polymer materials such as Torlon™ or Delrin™ may also be used. The polishing elements may be polymeric or may contain abrasive materials such as silica or alumina. in some cases, the polishing elements. may be made of PVA to provide good cleaning ability to the pad. The compliant under-layer of the present polishing pad is selected to provide compliance of the order of wafer level bow and warpage. A suitable under-layer material may be performance polyurethane made by Rogers Corporation.

As shown in FIG. 2, the polishing elements 202 may be distributed across the surface of the pad in a variety of patterns, depending on the intended application, and the patterns may be regular or irregular. In accordance with the present invention, one area 210 of the pad includes no polishing elements 202. This area 210 is intended to provide the transparent window through which a light bean may be passed when used with a CMP apparatus having polishing process monitoring means that utilize such light beams. By transparent it is meant that the window or other element passes all or substantially all or at least a useable portion of the radiation at the wavelengths of interest for the process monitoring means.

Figure 3:
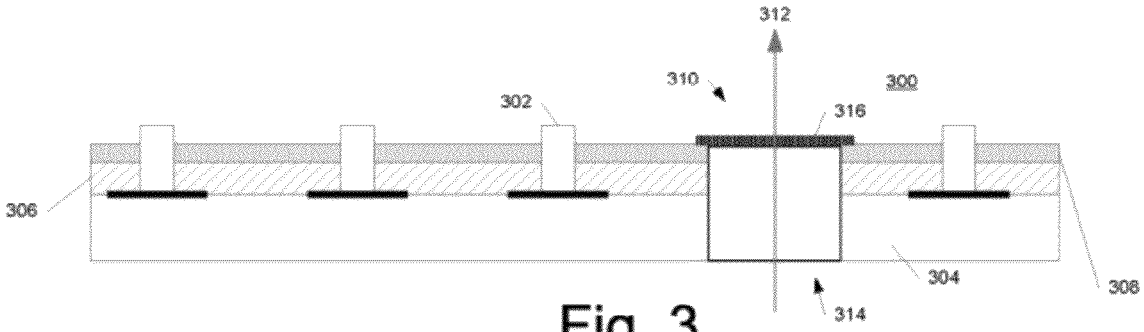
FIG. 3 is a cross-sectional view of a polishing pad with an optical path including a transparent window in accordance with an embodiment of the present invention.

Various configurations of the present polishing pad may be adapted for use in accordance with the present invention. For example, in the embodiment illustrated in FIG. 3, polishing pad 300 includes the optional slurry distribution layer 308 as well as guide plate 306 and compressible under layer 302. Area 310 of polishing pad 300 is free of polishing elements and in the region defined by area 310, an optical path 312 through the pad is formed by an aperture 314 that extends through the compressible under layer, the guide plate and the slurry distribution layer (if one is present).

Overlying this aperture is an optically transparent window 316 (by transparent it is meant that the window is transparent to the wavelengths of interest). The window may be made of any of a variety of materials, including but not limited to polycarbonate, thermoplastic polyurethane (TPU), high impact polystyrene (HIPS), poly(methyl methacrylate) (PMMA), polyester, or other optically transparent material (e.g., one or more polymeric materials, such as, a polyurethane or a halogenated polymer such as polychlorotrifluoroethylene (PCTFE), perfluoroalkoxy (PFA), fluorinated ethylene propylene (FEP), or polytetra-fluoroethylene (PTFE)). The window 316 may be molded, extruded, thermo-formed or cast and may be fixed in position over the slurry distribution layer of the pad by adhesive or by a thermal bonding layer (not shown).

In some instances, the window 316 may have rounded or beveled edges to facilitate easy sealing against the slurry distribution layer. Preferably, all interfaces between the window 316 and the pad 300 are sealed to eliminate (or substantially reduce) leakage into aperture 314. Likewise, the edges of compressible under layer and slurry distribution layer which abut the aperture may also be sealed, for example using adhesive or a thermal bonding layer (not shown). The window thickness does not extend beyond the tips of polishing elements 302, thereby preventing scratching of a wafer or other substrate even though the window 316 is positioned above the level of the top surface of the slurry distribution layer (if present) or the top surface of the guide plate (if the slurry distribution layer is not present).

Figure 4:
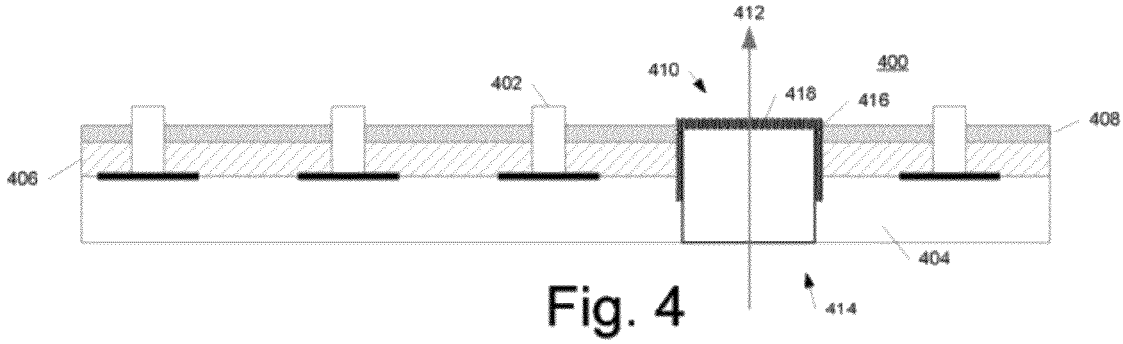
FIG. 4 is a cross-sectional view of a polishing pad with an optical path including a transparent C-shaped plug in accordance with an embodiment of the present invention.

Referring now to FIG. 4, a further polishing pad 400 is illustrated. Pad 400 includes the optional slurry distribution layer 408, as well as guide plate 406 and compressible under layer 402. Area 410 of polishing pad 400 is free of polishing elements and in the region defined by area 410, an optical path 412 through the pad is formed by an aperture 414 that extends through the compressible under layer, the guide plate and the slurry distribution layer (if one is present).

Fitted within the aperture 414 is a C-shaped transparent member (e.g. a C-shaped plug) 416 (the entire plug need not be transparent so long as the upper member 418 thereof is transparent to the wavelengths of interest). The transparent member 418 may be affixed to the sides of the guide plate and the compressible under layer (and the slurry distribution layer, if present) defined by the aperture 414 with any suitable adhesive or adhesively backed tape. In some embodiments, a cure in place adhesive may be used. in other cases, the C-shaped plug may be fixed in place using a thermal bonding adhesive. The edges of the C-shaped plug need not extend through the entire thickness of the guide plate and the compressible under layer and, in some embodiments, will extend only partially therethrough.

The top surface 418 of the C-shaped plug 416 may be made of any of a variety of materials, including but not limited to polycarbonate, TPU, HIPS, PMMA, polyester, or other optically transparent material (e.g., one or more polymeric materials, such as, a polyurethane or a halogenated polymer such as PCTFE, PFA, FEP, or PTFE). The C-shaped plug may be molded, extruded, thermo-formed or cast. The C-shaped plug does not extend beyond the tips of polishing elements 402, thereby preventing scratching of a wafer or other substrate even though a portion of the plug may extend above the level of the top surface of the slurry distribution layer (if present) or the top surface of guide plate (if the polishing composition distribution layer is not present).

Figure 5:
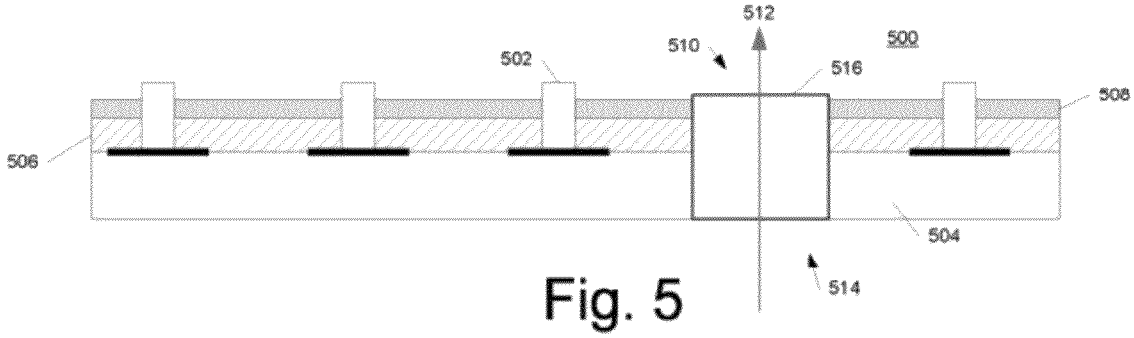
FIG. 5 is a cross-sectional view of a polishing pad with an optical path including a transparent plug in accordance with an embodiment of the present invention.

Referring now to FIG. 5, a further polishing pad 500 is illustrated. Pad 500 includes the optional slurry distribution layer 508, as well as guide plate 506 and compressible under layer 502. Area 510 of polishing pad 500 is free of polishing elements and in the region defined by area 510, an optical path 512 through the pad is formed by an aperture 514 that extends through the compressible under layer, the guide plate and the slurry distribution layer (if one is present).

Fitted within the aperture 514 is a rectangular-shaped transparent member (e.g. a plug) 516. Plug 516 is transparent to the wavelengths of interest. The plug 516 may be affixed to the sides of the guide plate and the compressible under layer (and the slurry distribution layer, if present) defined by the aperture 514 with any suitable adhesive or adhesively backed tape. In some embodiments, a cure in place adhesive may be used. In other cases, the plug may be fixed in place using a thermal bonding adhesive. The edges of the plug need not extend through the entire thickness of the guide plate and the compressible under layer and, in some embodiments, will extend only partially therethrough.

The plug 516 may be made of any of a variety of materials, including but not limited to polycarbonate, TPU, HIPS, PMMA, polyester, or other optically transparent material (e.g., one or more polymeric materials, such as, a polyurethane or a halogenated polymer such as PCTFE, PFA, FEP, or PTFE). The plug may be molded, extruded, thermo-formed or cast. The plug thickness does not extend beyond the tips of polishing elements 502, thereby preventing scratching of a wafer or other substrate even though the plug is positioned above the level of the top surface of the slurry distribution layer (if present) or the top surface of guide plate (if the polishing composition distribution layer is not present).

Figure 6B:
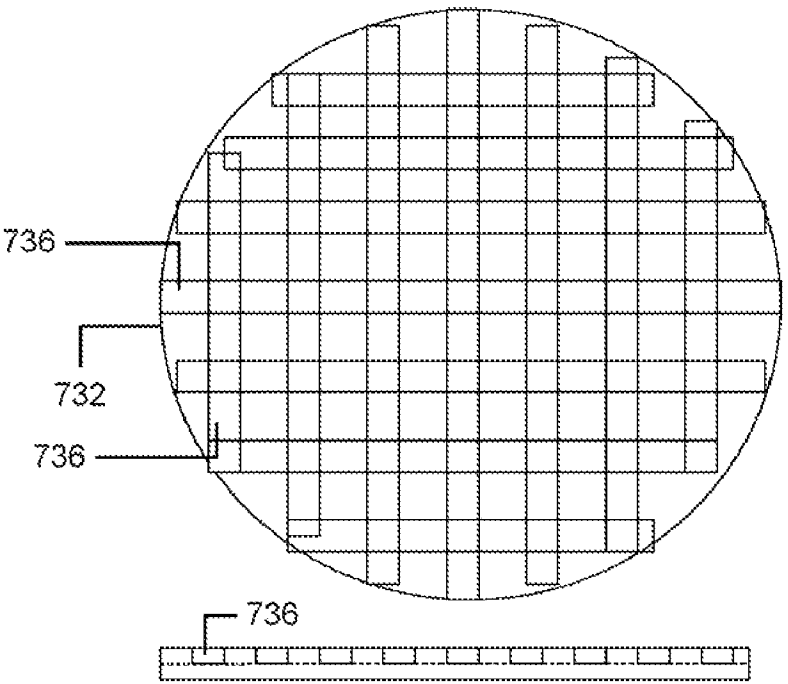
FIGS. 6A and 6B illustrate examples of guide plates fashioned for polishing material distribution in accordance with embodiments of the present invention.
Figure 6A:
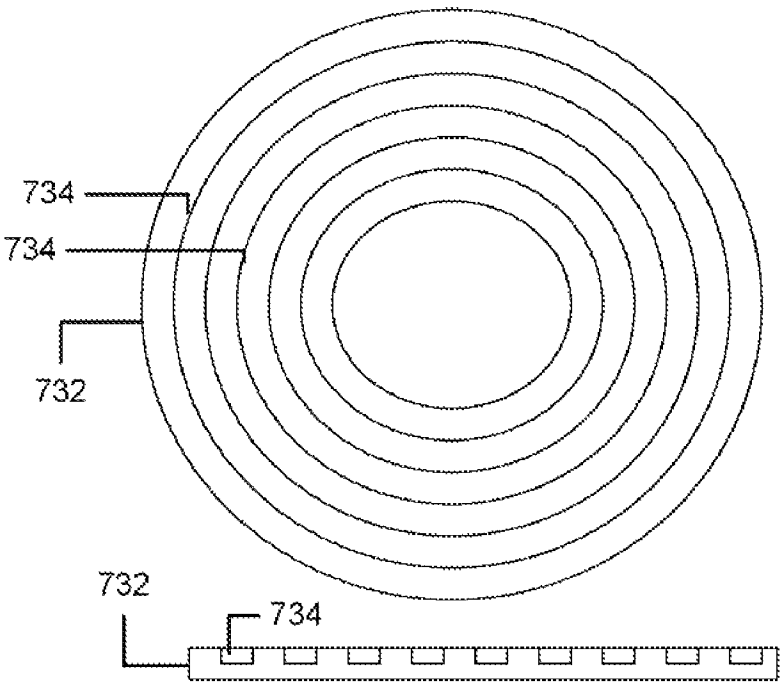

As indicated above, the slurry distribution layer is an optional component of the present polishing pad. In some cases, the guide plate may be used as means for polishing composition distribution during polishing operations. In such instances, a guide plate 732 may be fashioned with a series of circumferential grooves 734, as shown in FIG. 6A, or with a series of intersecting channels 736, as shown in FIG. 6B. The width of the grooves or channels may be on the order of the same size as the diameter of the elongated bodies of the polishing elements or may be smaller than said diameters. For example, the width of the grooves or channels may be on the order of $1/10^{th}$ the diameter of the elongated bodies of the polishing elements or from $1/10^{th}$ said diameter to the same size as said diameter. The width of the grooves or channels may vary across the face of the guide plate so as to provide preferred polishing material distribution profiles or paths.

Figure 7B:
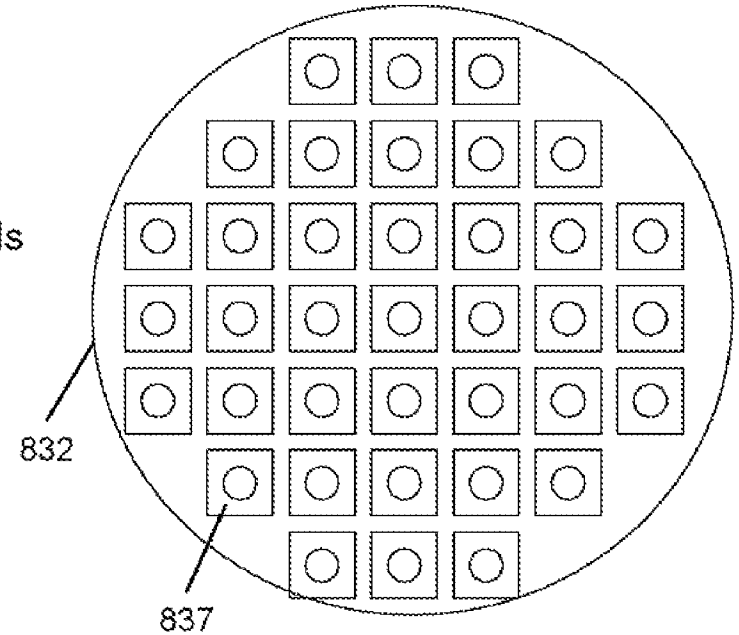
FIGS. 7A and 7B illustrate further examples of guide plates fashioned for polishing material distribution in accordance with embodiments of the present invention.
Figure 7B:
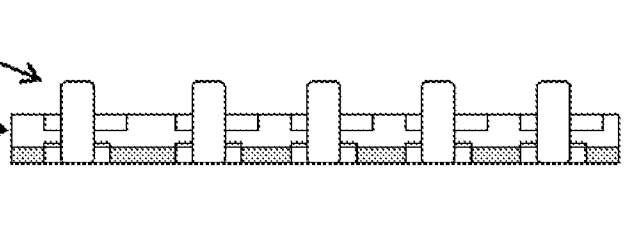
Figure 7A:
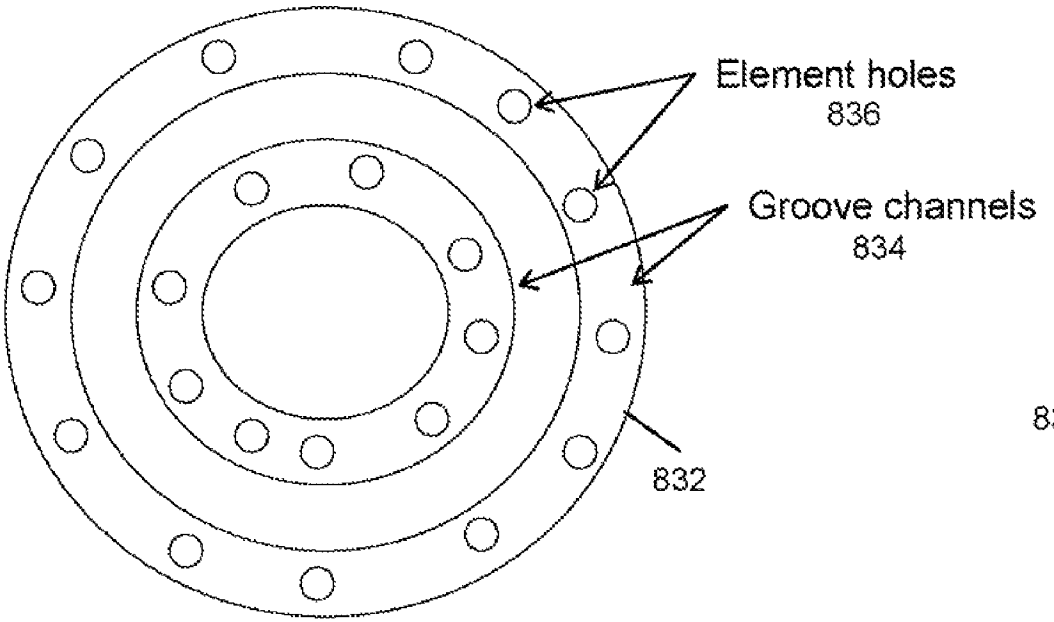

FIGS. 7A and 7B show further examples of guide plates 832 configured in accordance with embodiments of the present invention. Polishing elements 835 protrude through holes 836. The guide plate 832 may have grooves 834 in which the polishing elements are disposed, or individual channels 837 may be fashioned around each polishing element. In this example, the guide plate 832 includes a shim plate 838 which includes individual recesses for the polishing elements. The recesses are large enough to admit the flanges of the polishing elements, but the holes 836 in the guide plate are sized to permit only the elongated body of the polishing elements to extend through. Thus, the combination of the shim plate and the guide plat ensure that the polishing elements remain vertically oriented with respect to a plane defined by the guide plate.

Figure 8:
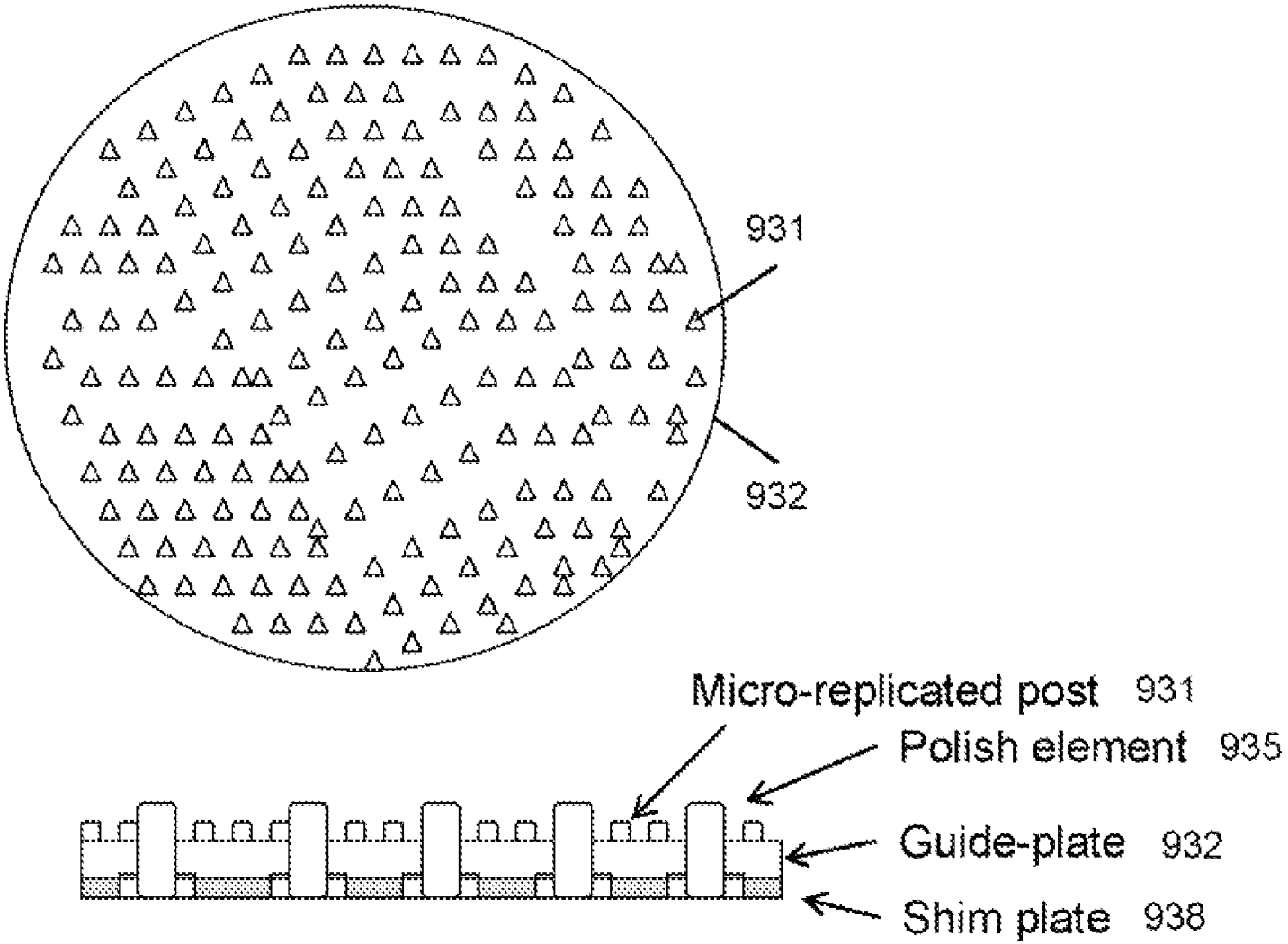
FIG. 8 illustrates yet a further example of a guide plate fashioned for polishing material distribution in accordance with embodiments of the present invention.

FIG. 8 shows still a further embodiment of a guide plate 932 fashioned in accordance with embodiments of the present invention. This guide plate includes micro-replicated posts 931, which are smaller than polishing elements 935 and which do not extend to the tips of the polishing elements, which are arranged over the surface of the guide plate 932 to provide for polishing material distribution. Any desired pattern of the micro-replicated posts may be used to effect a desired polishing material distribution profile. The micro-replicated posts may be affixed to the surface of guide plate 932 by any convenient means, including but not limited to adhesive. This example of a guide plate includes a shim plate 938, but this is optional.

The micro-replicated posts may be any shape, including but not limited to triangular, cylindrical, square, hexagonal, conical, truncated conical, truncated pyramidal, etc. In some embodiments the micro-replicated posts may have a cross-sectional area of 50-250 microns and a height of 50-250 microns.

Figure 9B:
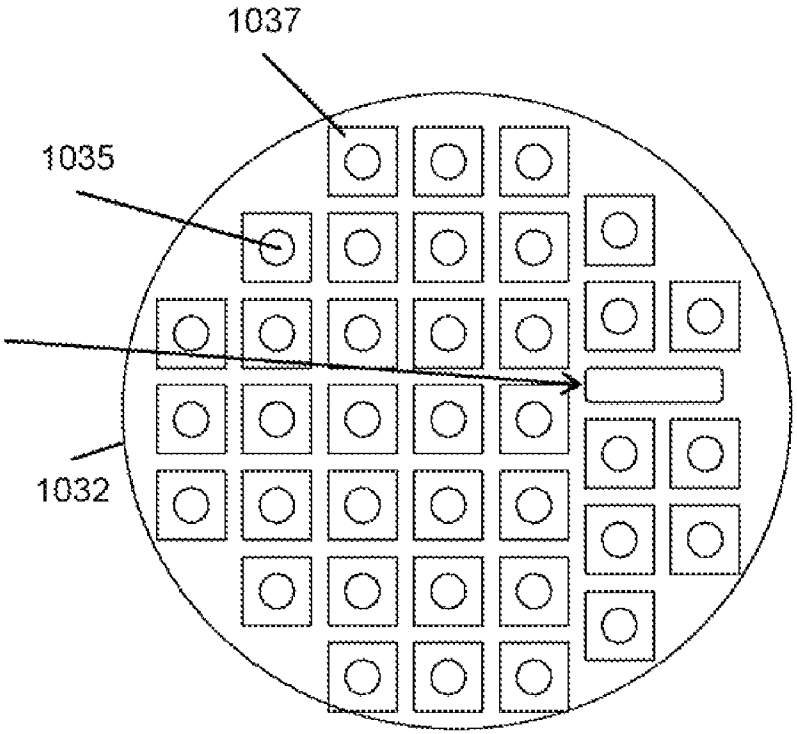
FIGS. 9A and 9B illustrate examples of guide plates fashioned for polishing material distribution and having transparent windows therein in accordance with embodiments of the present invention.
Figure 9A:
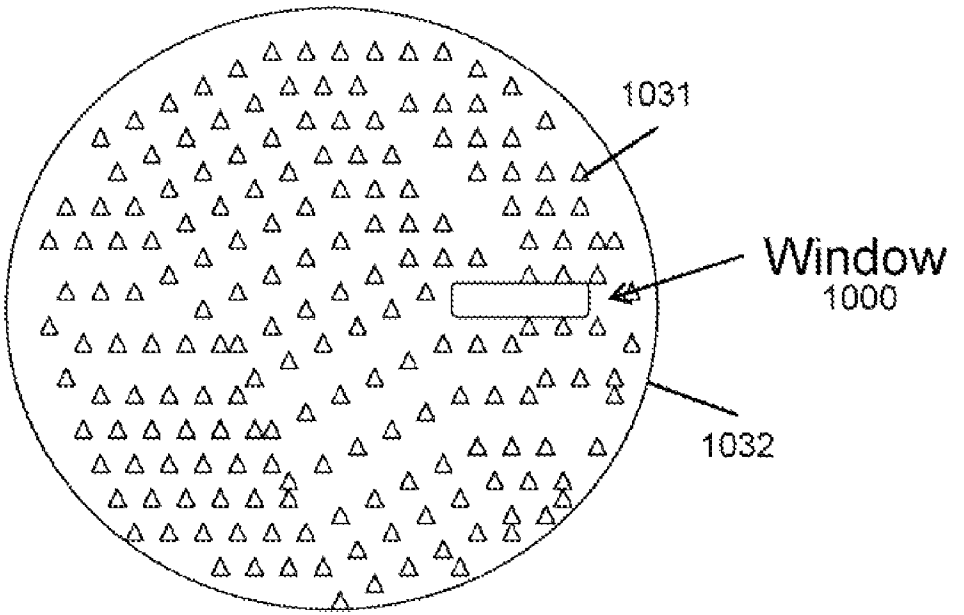

FIGS. 9A and 9B show how a transparent window 1000 may be incorporated into different embodiments of the guide plate 1032, whether it includes micro-replicated posts 1031 or not. The windows are located in areas free of polishing elements 1035, micro-replicated posts 1031 and channels 1037.

Figure 1:
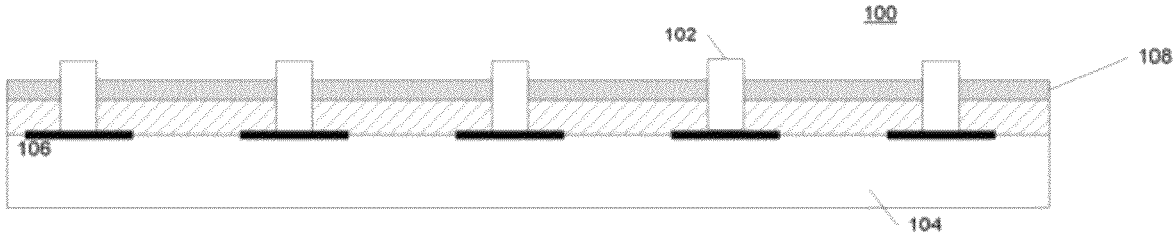
FIG. 1 is a schematic cross-sectional view of a CMP polishing pad having polishing elements that rest on a compressible under-foam and supported in vertical orientation by a guide plate.

Thus, structural and material properties of a CMP polishing pad utilized in CMP processing have been described. Embodiments of the invention may be fashioned by (a) making an aperture in a polishing pad such as that shown in FIG. 1 and described above, and then forming an optically transparent window overlying the aperture, or (b) making an aperture in a polishing pad such as that shown in FIG. 1 and described above, and then forming a window using a plug (or a C-shaped plug) that protrudes above the opening defined by the aperture.

In particular, in a polishing pad having a guide plate, a compressible foam under layer disposed adjacent to a lower surface of the guide plate, and a plurality of polishing elements that extend in a first direction substantially normal to a plane defined by the guide plate and through the guide plate, an aperture may be formed in the polishing pad, the aperture extending through the compressible foam under layer and the guide plate, and an optically transparent window may be affixed overlying the aperture, the optically transparent window being above an upper surface of the guide plate but below tips of the polishing elements, the upper surface of the guide plate being opposite the lower surface thereof. In cases where the pad further includes a slurry distribution layer disposed on the upper side of the guide plate, the aperture extends through the slurry distribution layer, and the optically transparent window overlies the aperture and is affixed to a top surface of the slurry distribution layer.

In a further embodiment, in a polishing pad having a guide plate, a compressible foam under layer disposed adjacent to a lower surface of the guide plate, and a plurality of polishing elements that extend in a first direction substantially normal to a plane defined by the guide plate and through the guide plate, an aperture is formed in the polishing pad, the aperture extending through the compressible foam under layer and the guide plate, and an optically transparent window is formed using a plug that is secured within the aperture and which protrudes above an upper surface of the guide plate but below tips of the polishing elements, the upper surface of the guide plate being opposite the lower surface thereof. In cases where the pad further includes a slurry distribution layer disposed on the upper side of the guide plate, the aperture extends through the slurry distribution layer, and the plug protrudes above a top surface of the slurry distribution layer.

What is claimed is:

1. A polishing pad comprising:

a guide plate;

a compressible foam under layer disposed adjacent to a lower surface of the guide plate; and a plurality of polishing elements that extend in a first direction substantially normal to a plane defined by the guide plate and through the guide plate; and an optical path along the first direction and defined by an aperture in the compressible foam under layer and the guide plate, the optical path including a transparent member that extends above an upper surface of the guide plate but below tips of the polishing elements, the upper surface of the guide plate being opposite the lower surface thereof.

2. The polishing pad of claim 1, further comprising a slurry distribution layer disposed on the upper side of the guide plate, wherein the polishing elements extend through the slurry distribution layer and the transparent window extends beyond a top surface of the slurry distribution layer.

3. The polishing pad of claim 2, wherein the transparent member comprises a portion of a C-shaped plug disposed in the optical path.

4. The polishing pad of claim 2, wherein the transparent member comprises a plug disposed in the optical path.

5. The polishing pad of claim 1, wherein the guide plate is fashioned to distribute slurry during polishing operations.

6. The polishing pad of claim 5, wherein the guide plate includes one or more of circumferential grooves, channels, or micro-replicated posts on the upper surface.

7. A method, comprising: in a polishing pad having a guide plate, a compressible foam under layer disposed adjacent to a lower surface of the guide plate, and a plurality of polishing elements that extend in a first direction substantially normal to a plane defined by the guide plate and through the guide plate, forming an aperture in the polishing pad, said aperture extending through the compressible foam under layer and the guide plate, and affixing an optically transparent window overlying the aperture, said optically transparent window being above an upper surface of the guide plate but below tips of the polishing elements, the upper surface of the guide plate being opposite the lower surface thereof

8. The method of claim 7, wherein the pad further include a slurry distribution layer disposed on the upper side of the guide plate, the aperture extends through the slurry distribution layer, and the optically transparent window overlies the aperture and is affixed to a top surface of the slurry distribution layer.

9. A method, comprising:

in a polishing pad having a guide plate, a compressible foam under layer disposed adjacent to a lower surface of the guide plate, and a plurality of polishing elements that extend in a first direction substantially normal to a plane defined by the guide plate and through the guide plate;

forming an aperture in the polishing pad, the aperture extending through the compressible foam under layer and the guide plate; and forming an optically transparent window using a plug that is secured within the aperture and which protrudes above an upper surface of the guide plate but below tips of the polishing elements, the upper surface of the guide plate being opposite the lower surface thereof.

10. The method of claim 9, wherein the pad comprises a slurry distribution layer disposed on the upper side of the guide plate, the aperture extends through the slurry distribution layer, and the plug protrudes above a top surface of the slurry distribution layer.

* * * * *